US005223388A

United States Patent [19]

Saitou

[11] Patent Number: 5,223,388

[45] Date of Patent: Jun. 29, 1993

[54] PROCESS FOR PRODUCING SILVER HALIDE EMULSION AND APPARATUS

[75] Inventor: Mitsuo Saitou, Kanagawa, Japan

[73] Assignee: Fuji Photo Film Co., Ltd, Kanagawa, Japan

[21] Appl. No.: 921,433

[22] Filed: Jul. 31, 1992

Related U.S. Application Data

[63] Continuation of Ser. No. 592,745, Oct. 4, 1990, abandoned.

[30] Foreign Application Priority Data

Oct. 5, 1989 [JP] Japan ..... 1-258862

[51] Int. Cl.[5] ..... G03C 1/015

[52] U.S. Cl. ..... 430/569; 430/567

[58] Field of Search ..... 430/569, 567

[56] References Cited

U.S. PATENT DOCUMENTS

| | | | |
|---|---|---|---|
| 3,773,516 | 11/1973 | Gutoff | 430/569 |
| 3,801,326 | 4/1974 | Claes | 430/642 |
| 4,046,576 | 9/1977 | Terwilliger et al. | 430/569 |
| 4,927,745 | 5/1990 | Irving | 430/569 |

FOREIGN PATENT DOCUMENTS

| | | | |
|---|---|---|---|
| 787336 | 12/1957 | United Kingdom | 430/569 |

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A process for producing a light-sensitive silver halide emulsion comprising the steps of:

(a) batchwise reacting in a first medium-sized reaction vessel an aqueous solution of a silver salt and an aqueous solution of a halide salt to form a silver halide emulsion comprising silver halide grains;

(b) transferring said silver halide emulsion to a second medium-sized reaction vessel;

(c) adding an aqueous silver salt solution and an aqueous halide salt solution or silver halide fine grains having a average diameter of at most 0.1 μm to said silver halide emulsion in said second medium-sized reaction vessel and batchwise reacting said mixture to grow silver halide on said silver halide grains;

(d) subsequently transferring the silver halide emulsion from said second medium-sized reaction vessel to a third medium-sized reaction vessel; and (e) batchwise subjecting said silver halide emulsion in said third medium-sized reaction vessel to at least one of desalting, chemical ripening or chemical sensitization.

14 Claims, 4 Drawing Sheets

PROCESS FOR PRODUCING SILVER HALIDE EMULSION AND APPARATUS

This is a continuation of application Ser. No. 07/592,745 filed Oct. 4, 1990, now abandoned.

FIELD OF THE INVENTION

This invention relates to an apparatus and process for producing a silver halide emulsion, whereby silver halide (hereinafter referred to as AgX) emulsion grains for photosensitive materials can be produced from small quantities to large quantities with good reproducibility by reacting a silver salt (herein after referred to as an "$Ag^+$ salt") with a halide salt (hereinafter referred to as an "$X^-$ salt").

BACKGROUND OF THE INVENTION

Examples of recent processes for producing a silver halide emulsion and apparatuses therefor include the following:

(1) An apparatus for the continuous production of an AgX emulsion in which an aqueous silver salt solution and an aqueous $X^-$ salt solution are continuously fed by a double jet method in the presence of a dispersion medium and the AgX emulsion obtained is continuously withdrawn from the reaction vessel during the formation of AgX grains, and an apparatus for the continuous production of an AgX emulsion in which an AgX emulsion continuously removed from a reaction vessel in cascade type reaction apparatuses connected with each other is used as a feed material for the subsequent reaction vessel.

Such conventional processes and apparatuses are described in V. L. Zelikmen and S. M. Levi, *Making and Coating Photographic Emulsions,* p. 228 (Focal Press, London) (1964); U.S. Pat. Nos. 3,773,516 and 4,046,576; and K. Ariga, *Journal of the Society of Photographic Science and Technology of Japan,* Vol. 30, 99 (1967).

(2) An apparatus for continuous production in which an AgX emulsion is continuously passed through a tube or a pipe and a number of inlet ports for an aqueous silver salt solution and an aqueous $X^-$ salt solution are provided midway between the top and bottom of the tube or pipe, as described in U.S. Pat. Nos. 3,655,166 and 3,827,888 and West German Patent (OLS) No. 2,755,166.

In the first process and apparatus described above, however, the withdrawn AgX grains differ in residence time in the reaction vessel, since the AgX emulsion is continuously withdrawn during the continuous nucleation. Thus the AgX emulsion obtained has a wide grain size distribution. Furthermore, the size distribution varies with the lapse of time. A constant size distribution can be achieved by shortening the residence time. In this case, however, the average grain size is undesirably reduced, as disclosed for example, in U.S. Pat. No. 3,801,326.

In the second process and apparatus described above an extremely long pipe line is required in order to give large grains, since the residence time of the emulsion in one part is short. When the flow rate of the emulsion is lowered so as to prolong the residence time, the mixing of the emulsion with the adjacent solution is accelerated by stirring, causes a wide grain size distribution. In a stirring means and an addition system in a closed system, furthermore, it is required to prevent solution leakage from the joint portion of the apparatus, which is undesirable. Furthermore, this apparatus differs from the small scale apparatus used for experimental research which makes production scale up difficult; the constant pipe length causes poor adaptability to various formulations differing in formulation period; and only limited stirring and mixing performance is achieved. .

Further there is the most basic problem, that an excellent process for producing an AgX emulsion established with the use of a small scale reaction apparatus used for experimental research (hereinafter referred to as small scale apparatus) should be applicable to the mass-production of the emulsion (usually performed by using a reaction vessel more than 600 liters in capacity) for commercial purposes.

Such production scale-up is particularly difficult for the following reasons:

(1) When an AgX emulsion is produced according to a specific production procedure in the small scale apparatus, the characteristics of the AgX emulsion differ from those of an AgX emulsion produced in a large scale reaction apparatus (hereinafter referred to as large scale apparatus). In the case of mass-production, therefore, some portion of the production procedure is frequently modified so as to match the properties of these emulsions with each other, which requires a great cost and a long time. This problem is particularly serious in the production of tabular emulsion grains having parallel twin planes.

(2) When a large amount of an emulsion, which is to be on sale in small portions, is produced at one time, some portion of the emulsion obtained should be discarded. This is because the use period of light-sensitive materials is limited and thus no stock is permitted. Accordingly, it is highly desirable to use a process whereby any emulsion can be produced in the needed amount, according to the demand in the market.

(3) In a batchwise process for the mass-production of an AgX emulsion for photosensitive materials, procedures from nucleation to crystal growth are usually performed in a single large vessel for a long period of time and thus a large amount of the emulsion is obtained at once. When it is impossible to use a large amount of the emulsion at once, however, most of the emulsion is divided into small portions and stored in a refrigerator, which requires additional efforts as well as a refrigerating cost. Further, it is required to warm the emulsion prior to the coating, which makes the process further complicated. Accordingly, it is highly desirable to develop a process for producing an AgX emulsion in a needed amount at short intervals of time, rather than producing a large amount of the emulsion at long intervals of time.

SUMMARY OF THE INVENTION

It is an object of the present invention to provide a process and apparatus therefor, whereby a silver halide emulsion having a narrow grain size distribution and any desired average grain size can be obtained with good reproducibility on a mass-production scale.

It is a further object of the present invention to provide a large-scale apparatus and for producing silver halide emulsions without altering the production conditions for a small scale reaction apparatus used for experimental research.

It is another object of the present invention to provide a process and apparatus for large scale production of silver halide emulsions with which small scale production is also possible.

It has now been found that these and other object of the present invention achieved by:

A process for producing a light-sensitive silver halide emulsion comprising the steps of:

(a) batchwise reacting in a first medium sized reaction vessel an aqueous solution of a silver salt and an aqueous solution of a halide salt to form a silver halide emulsion comprising silver halide grains;

(b) transferring said silver halide emulsion to a second medium-sized reaction vessel;

(c) adding an aqueous silver salt solution and an aqueous halide salt solution or silver halide fine grains having an average diameter of at most 0.1 μm to said silver halide emulsion in said second medium-sized reaction vessel and batchwise reacting said mixture to grow silver halide on said silver halide grains;

(d) subsequently transferring the silver halide emulsion from said second medium-sized reaction vessel to a third medium-sized reaction vessel; and (e) batchwise subjecting said silver halide emulsion in said third medium-sized reaction vessel to at least one of desalting, chemical ripening or chemical sensitization.

An apparatus for performing continuous multi-stage batch production of a silver halide emulsion, comprising:

(a) a first medium-sized reaction vessel comprising first means for introducing an aqueous silver salt solution, first means for introducing an aqueous halide salt solution, first means for agitating a first reaction mixture in said first reaction vessel and first means for draining said reaction mixture from said first reaction vessel;

(b) first means for transferring said first reaction mixture to a second medium-sized batch reaction vessel, connecting said first means for draining said first reaction vessel and said second reaction vessel;

(c) said second medium-sized batch reaction vessel comprising second means for introducing an aqueous silver salt solution, second means for introducing an aqueous halide salt solution, second means for agitating a second reaction mixture in said second reaction vessel and second means for draining said second reaction mixture from said second reaction vessel;

(d) second means for transferring said second reaction mixture to a third medium-sized batch reaction vessel, connecting said second means for draining said second reaction vessel and said third batch reaction vessel;

(e) said third batch reaction vessel comprising: at least one of (A) third means for introducing an aqueous silver salt solution, third means for introducing an aqueous halide salt solution, third means for agitating a third reaction mixture in said reaction vessel, (B) means for desalting said second reaction mixture;

(C) means for ripening said second reaction mixture; and (D) means for sensitizing said second reaction mixture; said third reaction vessel further comprising third means for draining said third reaction mixture from said third reaction vessel; and (f) means for controlling each of said means for introducing solutions and each of said means for draining each said reaction vessel, such that simultaneous multistage batchwise reactions are conducted in at least two of said three reaction vessels.

DETAILED DESCRIPTION OF THE INVENTION

Figure 1:
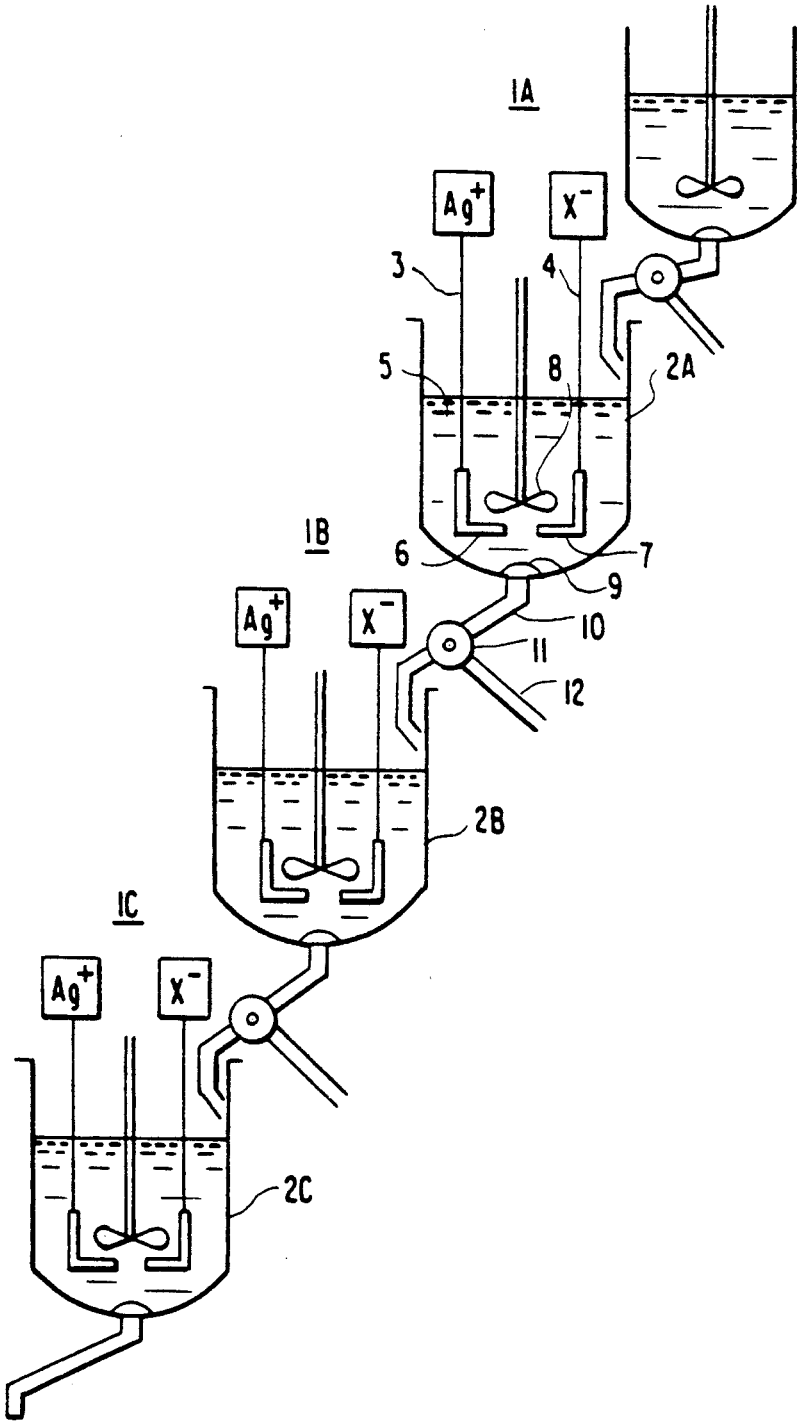
FIGS. 1, 2A, 2B, 3A and 3B each is sectional view of an apparatus of the present invention for producing an AgX emulsion.

Now the present invention is described in greater detail.

When a production-scale apparatus completely differs in form from a small scale apparatus for experimental research, it is uncertain whether AgX emulsion grains of the same properties can be produced by using both. When AgX emulsion grains differing in properties are obtained by using these apparatuses, furthermore, the difference in the form of these apparatuses makes it difficult to analyze the reasons for the difference in the properties of the obtained grains. In the apparatus of the present invention, therefore, the form and size are as close as possible to the small scale one for experimental research. In the case of a small scale apparatus for experimental research, a small amount of an AgX emulsion is produced and its properties are examined. Thus the AgX emulsion is necessarily produced in a reaction vessel of a small capacity by a batch system. Therefore a batch system is necessarily employed in the apparatus of the present invention.

AgX emulsions are now being improved and thus their formulations are being altered. Furthermore, a production apparatus is required to be able to produce various emulsions, namely, from small-sized grains to large-sized ones. Thus the apparatus of the present invention has a flexible application capable of satisfying these requirements.

In the production of tabular emulsion grains having parallel twin planes, it is required to control various supersaturation factors, particularly in the reaction solution during nucleation, with high accuracy so as to minimize nonuniformity, as are described in JP-A-2-838, JP-A-2-146033 and JP-A-63-92942. (The term "JP-A" as used herein means an "unexamined published Japanese patent application"). During the crystal growth, furthermore, emulsion grains of a better monodispersibility can be obtained by uniformly controlling the degree of the supersaturation of the crystal growth in the reaction solution. In the case of mixed crystal growth, it is desirable to uniformly control the composition of the reaction mixture in order to control the halogen composition ratio of the growth phase. Generally speaking, more uniform control can be achieved in a small amount of a reaction solution in a small scale vessel than in a large amount of a reaction solution in a large scale vessel, since the circulation frequency in the former case is higher than that in the latter case. From this point of view, a vessel of small capacity is preferable. A small capacity vessel is further preferred since it better corresponds to a small scale apparatus used for experimental research. From an economic viewpoint, furthermore, five reaction apparatuses of 400 liters in capacity can be manufactured at a lower cost than one reaction apparatus of 2,000 liters in capacity, which also indicates that a small scale apparatus is preferred to a large scale one.

In the present invention, the size of the vessel for nucleation, is minimized. This is important because nucleation is a particularly important step in the grain forming reaction.

A simple apparatus makes the analysis of an abnormality, if any, easy. In order to simplify an apparatus, it is required to specialize the function of the apparatus. It is preferred to perform the nucleation, ripening and growth in separate vessels, using one vessel exclusively for example, for the nucleation. Thus the performance of the apparatus, which is used exclusively for nucleation, can be optimized.

A narrow grain size distribution of emulsion grains is usually preferable, since high contrast and an improved double-layered effect can be achieved thereby. Thus it is preferred to obtain emulsion grains of a good monodispersibility. In order to satisfy this requirement, it is necessary that all the emulsion grains have the same residence time.

Based on the above considerations, the present invention relates to an apparatus for the continuous production of an AgX emulsion, as similar as possible to the small scale apparatus used for experimental research wherein two or more middle scale batch-type reaction apparatuses (hereinafter referred to as middle scale apparatuses) are arranged in series. Particular examples of this apparatus include those shown in FIGS. 1 to 3 as well as those obtained by combining two or more of these apparatuses.

The operation of the apparatus will be described with reference to the apparatus of FIG. 1 as a typical example. The time required for the preparation of an AgX emulsion is referred to as t. A reaction solution is fed into a reaction vessel 2A of a reaction apparatus 1A and the grain forming reaction is performed for a period of t/3. Next, the solution is transferred into a vessel 2B and a fresh reaction solution is fed into vessel 2A. Then the grain forming reaction is performed in each of vessel 2A and 2B for a period of t/3. Then the solution in vessel 2B is transferred into a vessel 2C and the solution in vessel 2A is transferred into vessel 2B, followed by feeding a fresh reaction solution into vessel 2A. Then the grain forming reaction is performed in each vessel for a period of t/3. This procedure is then repeated. During these steps, the grain forming reaction in vessel 2B may be initiated as soon as the solution in the 2B is transferred into the 2C and the solution in vessel 2A is transferred into vessel 2B, without waiting until the fresh reaction solution is fed into vessel 2A. Furthermore, a step of washing each reaction vessel may be provided after transferring each solution, if desired.

It is preferable to provide one or more washing steps in each vessel with shower water using a conventional shower head (not shown), in particular, $n \leqq 6$.

In the multistage reaction apparatus according to the present invention, the value n, which means the number of said middle scale reaction vessels (2A, 2B, 2C, etc.) arranged in series, is 2 or above and preferably ranges from 2 to 8, more preferably from 3–7, most preferably 3 to 4. When the number of separate reaction vessels is increased, the production efficiency is advantageously increased. For example, an apparatus consisting of three vessels of a capacity of 100 liters arranged in series may be compared with another consisting of 10 vessels arranged in series. In each case, an AgX emulsion is produced within 120 minutes, each liquid transfer time is 1 minute and the yield of the emulsion at the final stage is 80 liters. In continuous operation, 80 liters of the emulsion is produced in 42 minutes in the former case. On the other hand, 80 liters of the emulsion is produced in 14 minutes in the latter case.

In the present invention, the size of the reaction vessel, and in particular the vessel of an apparatus for the nucleation, is reduced without altering the emulsion yield per unit time. In addition, an increase in the number of reaction vessels value causes an advantage that a washing step is not required after each liquid-transfer, for the following reason. Namely, an increase in the number of reaction vessels shortens the grain forming reaction time in each reaction vessel, which decreases the grain size difference between the emulsion grains in a certain vessel and those in the vessel just before it. As a result, the contamination of the emulsion with the one remaining in the adjacent vessel after the liquid-transfer, if any, would scarcely affect the grain size distribution of said emulsion. Thus it is possible to omit the washing step. When the number of vessels exceeds 9, however, the equipment cost is increased and the entire apparatus is excessively large. Furthermore, the ratio of the transfer time to the reaction time increases and the contribution of Ostwald ripening also increases, when the reaction temperature is high. For these reasons, it is preferred that the number of reaction vessels is at most 8.

The apparatus of the present invention is applicable to the production of any emulsions ranging from small-size grain emulsions to large-size ones, namely, from short to long time formulations. More particularly, the number of the middle scale apparatuses to be used may be increased depending on the reaction time and/or the average residence time in each middle scale apparatus may be prolonged in the case of long time formulation. The number of middle scale apparatuses may be decreased and/or the average residence time may be shortened in the case of short time formulations.

For reducing Ostwald ripening and avoiding waste of time, it is desirable to shorten the transfer time as far as possible. For this purpose, it is preferred that the liquid-contact portions of the middle scale apparatuses are made of a material having a contact angle with water exceeding 90°, for example, Teflon or stainless steel coated with Teflon. This is because the interaction between the reaction solution and the vessel side wall is reduced, and, therefore, the amount of the solution remaining after transfer can be reduced and thus the transfer of the solution can be quickly performed. Alternately, the transfer time can be shortened by enlarging the internal diameter of the transfer pipe and reducing its length. In this case, however, the amount of the solution remaining in the pipe during the transfer is increased. Thus the size of the pipe should be selected by taking these factors into consideration. The transfer time is preferably within 2 minutes, more preferably within 60 seconds.

In the present invention, the reaction solutions in the vessels are not substantially mixed with each other. This means that the amount of the remaining solution in a reaction vessel after transferring the solution into the reaction vessel is preferably 10% or less (more preferably 3% or less) based on the amount of the solution transferred.

Figure 2A:
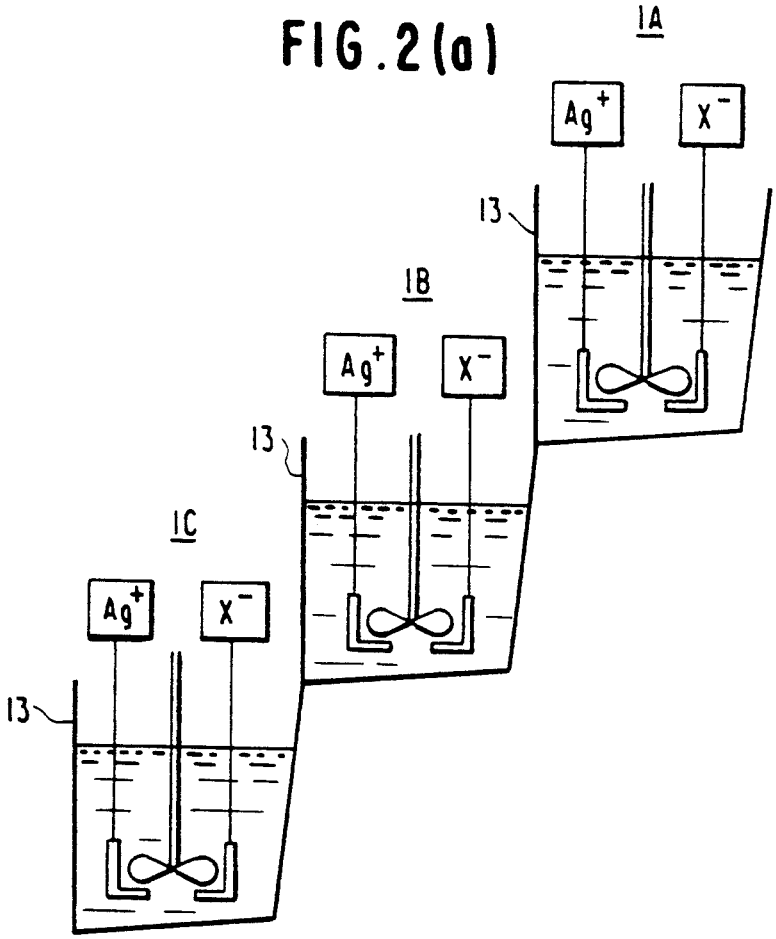
Figure 2B:
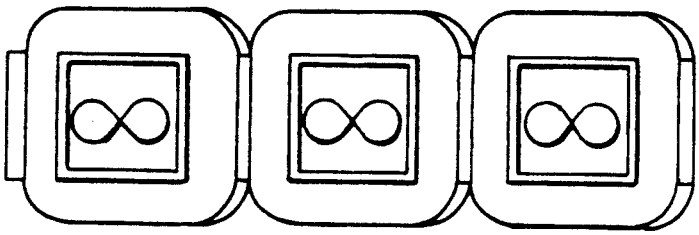
Figure 3A:
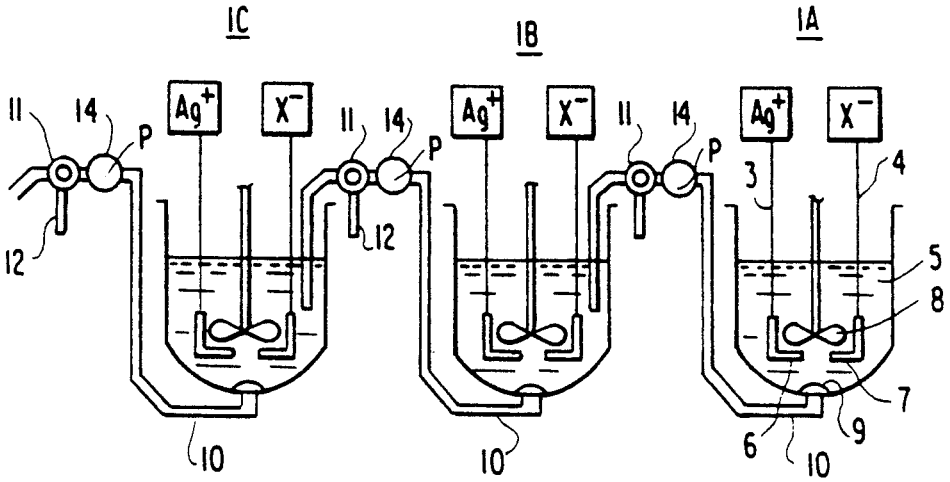
Figure 3B:
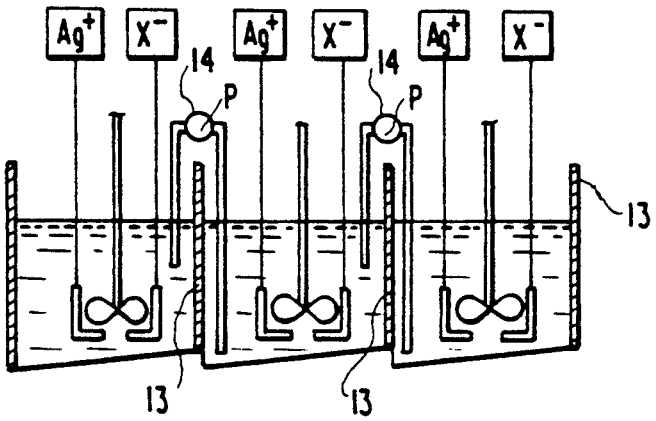

Now embodiments of the present invention will be described with reference to the drawings. In FIGS. 1 to 3, a liquid transfer port 9 of each reaction vessel 2A for transferring a reaction solution into the subsequent reaction vessel 2B is preferably provided by setting a switch valve at the bottom of said reaction vessel 2A, to thereby minimize the amount of the solution remaining in the vessel after the liquid-transfer.

It is preferable that each middle scale reaction apparatus, in particular, the one for the nucleation is the same as a small scale apparatus for experimental research in form. In the reaction apparatus 1A, it is preferable that the added aqueous silver salt solution ($Ag^+$) and aqueous halide solution ($X^-$) are uniformly and rapidly mixed into said reaction solution 5. It is therefore preferred these solutions ($Ag^+$ and $X^-$) are directly added respectively from inlet pipes 3 and 4 into said reaction solution 5 (namely, under the liquid surface) and then vigorously stirred with stirring blades 8 equipped near the inlets 6 and 7 respectively. It is further preferable that said solutions are added via a porous material.

In particular, in a large scale apparatus, the flow stream of an aqueous silver salt solution and an aqueous halide solution being added are increased in size, thereby the nonuniformity of the concentration of the solute near the inlet is increased. This is one reason for the difference in performance caused by increasing the production scale of the silver halide emulsion. On the other hand, when the solutions are added through a porous material, the nonuniformity is greatly reduced. The expression "porous material" as used herein means a material having at least 4, preferably at least 10, and still preferably from $10^2$ to $10^{15}$ pores per one solution to be added, the pore size of the pores being not larger than 2 mm, preferably from 0.5. mm to 100 Å, and still preferably from 0.1 mm to 0.1 μm. In particular, a hollow tube having a porous film wall is preferred for simplicity and ease of use, as described in Japanese Patent Application No. Hei-2-78534.

Also, in the present invention, as a method of supplying solute ions for growing silver halide crystals in the large scale apparatus, a method of supplying a previously prepared very fine grain silver halide emulsion (AgCl, AgBr, AgI and/or mixed crystals thereof) having a size not larger than 0.1 μm is particularly preferred. The very fine silver halide grains are gradually dissolved after being uniformly mixed with a large amount of a silver halide emulsion and also the concentration distribution of the solute larger than the equilibrium solubility thereof does not occur. Accordingly, it becomes possible to attain uniform crystal growth of the seed crystals in the large scale apparatus. The very fine silver halide grains are preferably non-defect grains substantially free from any multiple twin grains (grains containing two or more twin planes in one silver halide grain) or screw-dislocation grains. In this case, the term "substantially" means that the ratio of the defect grains is less than 5%, and preferably less than 1%. Details of the preparation process for the very fine silver halide grains are described in JP-A-1-183417 and Japanese Patent Application No. Hei-2-142635.

This method is preferably used in the present invention for the production of tabular emulsion grains having parallel twin planes, and in particular, for the production of parallel double twin tabular emulsion grains described in JP-A-2-838 and substantially nontwin emulsion grains described in JP-A-2-146033.

Suitable addition systems and stirring means, reaction vessels, solute-addition system and stirring blades are described for example, in *Research Disclosure,* Vol. 166 (Item 16662) (Feb., 1978), Japanese Patent Application No. Hei-2-78534, U.S. Pat. Nos. 3,897,935, 3,790,386, 3,415,650, 3,692,283, 4,289,733 and 3,785,777, JP-A-57-92524 and JP-A-60-117834.

FIG. 1 is a side sectional view of an embodiment of the cascade-type apparatus of the present invention. When a valve 9 located at the bottom of each reaction vessel 2 is opened, the solution in the vessel is transferred into the next one by gravity.

FIG. 2 shows an embodiment of the step-type apparatus of the present invention. (a) is a side sectional view of said apparatus while (b) is a top view thereof. In this apparatus, no transfer pipe 10 is required but the slope of an inclined vessel side wall 13 (vertically movable) and the bottom of the vessel provide a means for transferring the solution. In such an apparatus, no solution remains in the transfer pipe 10 and, furthermore, neither a switch valve 11 nor a pipe for waste water 12 is required. It is further advantageous in that the solution can be rapidly transferred into the next vessel. The liquid transfer may be carried out by moving the movable vessel side wall 13 either vertically or horizontally. Alternately, a switch valve may be provided at the lower portion of vessel side wall 13. In the apparatuses shown in FIGS. 1 and 2, no pressure is applied for liquid supply.

This system is advantageous in that the liquid transfer can be rapidly carried out simply by switching the valve, which has a low cost, and that little solution remains.

FIG. 3 shows an apparatus wherein each middle scale apparatus is arranged almost horizontally and a liquid is transferred by using a pump 14. The apparatuses may be either independent from each other as shown in FIG. 3. (*a*) or integrated together FIG. 3. (*b*), depending on the purpose. In FIG. 3, each symbol has the same meaning specified in FIG. 1 or 2.

The liquid transfer pump to be used herein is any suitable conventional device whereby a liquid at a lower level is transferred to an upper level with the use of external power. Details thereof are described in *Kaoaku Sochi Binran,* ed. by Society of Chemical Technology, Chaps. 17 and 18, Maruzen (1989).

Figure 4A:
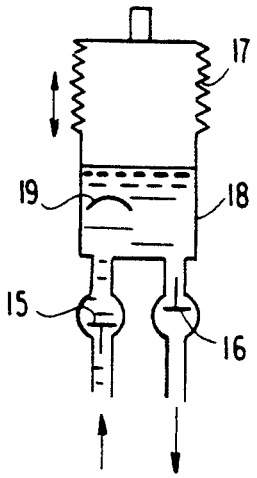
FIGS. 4A, 4B and 4C shows sectional views of typical examples of a transfer pump wherein (a) shows a diaphragm type pump, (b) shows a vacuum suction pump and (c) shows a reciprocating pump.
Figure 4B:
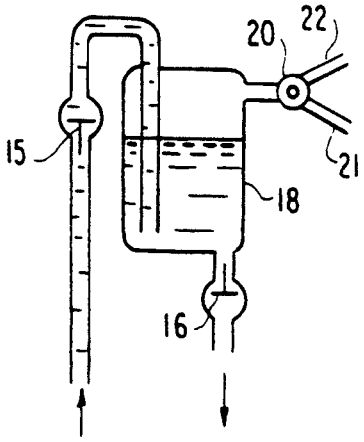
Figure 4C:
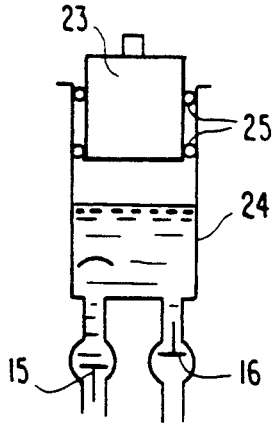

In the apparatus of the present invention, it is preferred to use a pump whereby liquids can be transferred without exerting undesirable effects, for example, pressure fogging to the AgX emulsion. From this point of view, the diaphragm pump (a), the vacuum suction pump (b) and the reciprocating pump (c), each shown in FIG. 4, are preferably used. In each case, the pressure within a liquid transfer pipe is reduced so as to suck up the emulsion which is then transferred into the next middle scale vessel through the interlocked functions of check valves 15 and 16. FIG. 4 shows particular examples thereof.

In FIG. 4 (a) to (c), 15 and 16 respectively show check valves for suction and discharge. FIG. 4 (a) shows an example of the diaphragm pump wherein the pressure within a liquid suction vessel 18 is reduced by raising a bellows-type diaphragm 17 and then a reaction solution is drawn up into the liquid suction vessel 18 via the check valve for suction 15. When the bellows-type diaphragm 17 is brought down, the reaction solution in the suction vessel 18 is transferred via the check valve for discharge 16. A guard 19 is provided in order to inhibit the scattering of the solution introduced FIG. 4. (b) shows an example of the vacuum suction pump, wherein the pressure within a suction vessel 18 is reduced by turning a valve 20 to the reduced pressure system 21 and then a reaction solution is drawn up into the suction vessel 18 via a check valve for suction. When the amount of the solution introduced exceeds a predetermined level, the suction is turned off and the valve 20 is turned to the atmospheric or elevated pressure system 22. Then the reaction solution in the suction vessel 18 is transferred via a check valve for discharge 16. The amount of the sucked solution may be controlled by adjusting the interval of suction time. FIG. 4 (*c*) shows an example of the reciprocating pump, wherein the pressure within a cylinder 24 is reduced by raising a piston 23 and then a reaction solution is drawn up into the cylinder 24 via a check valve for suction 15. When the piston 23 is brought down, the reaction solution in the cylinder 24 is transferred via a check valve for discharge 16. 25 is an anti-air leakage packing.

In each of the pumps (a) to (c), the AgX emulsion never comes in contact with a movable portion of the pump. Thus it is not abraded and worm out. The length and diameter of each pipe, the location of each check valve and other constructional factors of the apparatuses may be selected in such a manner as to elevate the liquid transfer rate as much as possible and to minimize the amount of the remaining solution. In addition, each pump may be washed by passing washing water, instead of the reaction solution, therethrough, if required.

In the pumps shown in FIG. 4 (*a*) or (*c*), the relationship among the increased volume $V_1$ in the suction vessel 18 or the cylinder 24, which is varied by moving the bellows-type diaphragm 17 or the piston 23, the original volume $V_2$ and the internal pressure during the suction $P_2$ may be represented as follows:

$$P_1 \cdot V_1 = P_2 \cdot (V_1 + V_2)$$

wherein P represents the pressure prior to suction. Namely, an appropriate suction rate can be selected by controlling the ratio $V_1/V_2$.

Furthermore, the apparatus of the present invention may be equipped with a controlled double jet (C.D.J.) controlling system. Details thereof are described in F. Claes and R. Berendsen, *Phot. Korr.*, Vol. 101, 37 (1965).

Generally speaking, nucleation is the most important step during the formation of AgX grains. The performance of the AgX emulsion finally obtained largely depends on the nuclei thus formed. Therefore it is preferred that the nucleation is carried out under conditions similar to those employed in a small scale apparatus for experimental research, as close as possible to thereby form similar nuclei. In order to achieve this object, the reaction vessels can be further miniaturized by the following methods.

Figure 5:
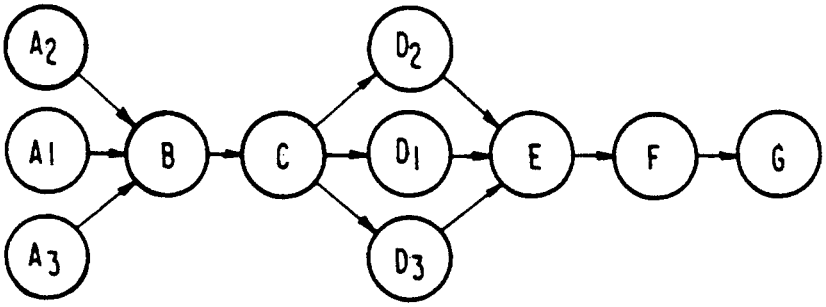
FIG. 5 is a schemaric description of one embodiment of the arrangement of batch-type reaction apparatuses and branched reaction apparatuses according to the present invention.

(1) As shown in FIG. 5 $A_1$ to $A_3$, 2 or more, preferably 2 to 5, reaction apparatuses for nucleation are employed. In this case, the nucleation is carried out in the apparatuses A , $A_2$ and $A_3$ in FIG. 5. After the completion of the nucleation, each reaction solution is transferred into B wherein the subsequent ripening or crystal growth is carried out.

(2) As another embodiment, nuclei are formed in $A_1$, $A_2$ and $A_3$ in FIG. 5. After the completion of the nucleation, each reaction solution is transferred into B. After repeating this procedure 1 times, the solution in B is transferred into C wherein ripening or crystal growth is carried out. In this case, one or more, preferably 2 to 5, reaction apparatuses A are provided. It is furthermore preferred to keep the inside of B at a low temperature (10° to 40° C.) to thereby prevent the nuclei upon storage from changing. In this case, the capacity of the small scale apparatus for nucleation is shown in Table 1.

In the nucleation step, it is generally preferable that the aqueous silver salt solution and the aqueous halide solution are added each in a calculated amount, determined not by the controlled double jet (C.D.J.) method, but with the use of a fine constant delivery pump. During the initial stage of the nucleation, the potential of silver in a solution containing an excessive amount of the X. salt would shift toward the positive region. Thus, controlling the silver potential would, make the controlled pAg value inaccurate.

Details of these and other conditions for the nucleation step are described in JP-A-2-838, JP-A-2-146033, and Japanese Patent Application No. Hei-1-90089.

TABLE 1-1

| | Apparatus capacity | | |
|---|---|---|---|
| | Range (l) | Preferable range (l) | More preferable range (l) |
| Small scale apparatus for experimental research | ~10 | 1~5 | 1~5 |
| Large scale apparatus for mass-production | 600~ | 1,000~7,000 | 2,000~6,000 |
| Middle scale apparatus for batch-type (1st stage) | 10~ | 10~700 | 50~400 |
| Middle scale apparatus for batch-type (2nd to final stage)*1 | 20~ | 20~1,000 | 100~800 |
| Branched reaction apparatus (for nucleus formation) | ~300 | 10~300 | 20~200 |
| Middle scale apparatus for batch-type (Subsequent stage)*2 | 20~ | 20~1,000 | 100~800 |
| Large scale apparatus (Subsequent stage)*2 | 600~ | 1,000~7,000 | 2,000~6,000 |

Remarks
*1 1st to final stage mean those for preparing AgX grains.
*2 Subsequent stage means those for desalting, chemical sensitizing and adding photographic additives.

TABLE 1-2

| | Reaction conditions | | |
|---|---|---|---|
| | Range | Preferable range | More preferable range |
| Maximum difference in reaction time of each apparatus (%) | ~30 | ~15 | ~10 |
| Volume ratio of reactant/apparatus (%) | 25~ | 30~90 | 50~90 |
| Showing temperature (°C.) | 25~ | 30~75 | 35~60 |

When small scale apparatuses are linearly arranged in series as shown in FIGS. 1 to 3, furthermore, it is required to design the whole apparatus to make the reaction times in each apparatus in series almost equal (refer to Table 1). When the reaction times are different in different stages, the residence time of the emulsion in each apparatus must be adjusted to the longest one, which is inefficient. In order to solve this problem, branched reaction apparatuses $D_2$ and $D_3$ whose capacity is the same as $D_1$, as shown in FIG. 5, may be optionally provided. Setting up one branched-apparatus make it possible to extend the reaction period in the step by about two times. It is preferred that from 1 to 5, more preferably 1 to 3, of the branched reaction apparatuses are provided when requred in a reaction step. When the number of the branched reaction apparatuses exceeds 5, the whole apparatus becomes too large, which increases cost. More particularly, these branched reaction apparatuses are used where crystals are grown without stopping, depending on a certain function, by an accelerating addition method while continuously varying the halogen composition for a specific period of the crystal growth step; or crystals are grown at a temperature of $T_1$°C. for a specific period of the crystal growth stage and at a temperature of $T_2$°C. for the remaining period. The use of the branched apparatuses has the additional advantage that it is unnecessary to stop the operation of the whole apparatus even if a certain apparatus is damaged. These branched reaction apparatuses are preferably transferable depending on the formulation. It is preferable, for example, the apparatus $D_2$ shown in FIG. 5 can be transferred so as to be used as $C_2$. The small size of the apparatus of the present invention permits such a transfer. In this case, each connecting pipe in FIG. 1, 3 or 4 is preferably an easily removable coupling type one. Details of these pipes, check valves and pipe connection are described in *Kagaku Kogaku Binran,* ed. by Society of Chemical Technology, Chap. 13, Maruzen (1989).

In a conventional apparatus, for example, all steps from a nucleation reaction to crystal growth are usually performed in a single reaction vessel. Thus, the amount of the reaction solution at the nucleation is frequently controlled to less than ⅓ of the capacity of the reaction vessel. In this case, when the solution is stirred vigorously, the reaction solution becomes bubbly to thereby reduce the stirring effect. In contrast, the apparatus of the present invention makes it unnecessary to allocate this space. Accordingly, the amount of the reaction solution can be increased. As a result, the reaction solution can be stirred vigorously and thus more uniform nuclei can be formed. Furthermore, more nuclei can be formed by a single reaction. The amount of the reaction solution preferably ranges from 30 to 90%, still preferably from 50 to 90%, of the capacity of the middle scale vessel. Therefore the capacity of the reaction vessels of the apparatus of the present invention increases in the order of nucleation→ripening→crystal growth, as the amount of the reaction solution increases.

In the apparatus of the present invention, no addition system other than the one employed during the nucleation is required. Namely, no addition system for various halogen compositions or concentrations is required and, furthermore, the addition system used has a small capacity, which facilitates the miniaturization and simplification of the apparatus. In addition, the number of solutions to be measured is less.

The same advantages exist for the apparatus for crystal growth.

Further, the nucleation step is separated and thus it is unnecessary to control the number of stable nuclei. For example, a conventional process for the production of normal crystal AgX grains includes nucleation followed by ripening so as to reduce the number of stable nuclei. However the apparatus of the present invention is further advantageous in that no such ripening step is required, since the small scale reaction vessel for nucleation makes it possible to reduce the number of stable nuclei. In the apparatus of the present invention for producing an AgX emulsion, the term "continuous production" means that a phenomenon occurs continuously, and is to say, the AgX emulsion is repeatedly produced in a definite amount at definite intervals.

The capacities of the experimental small scale apparatus, the large scale apparatus for production and the mid-scale apparatus (the one for the first step, the one for the second to final step) are summarised in Table 1.

The emulsion thus repeatedly produced at definite intervals may be desalted and concentrated in the following manner.

(I) When the emulsion is produced in a large amount, the emulsion is successively poured into a desalting tank of large scale. When the amount of the emulsion in the large tank reaches a predetermined level, it is desalted in a conventional manner. The emulsion subsequently produced is introduced into another large scale tank for desalting. These procedures are alternately repeated.

(II) When the emulsion produced in a mid-scale, the produced emulsion is transferred into a middle scale vessel for desalting, desalted therein and then transferred into the next step. Namely, medium portions of the desalted and concentrated emulsion are produced at definite intervals.

Particular examples of the desalting method are as follows: (1) adding an emulsion sedimenting medium and washing the sediment thus formed with water; (2) making gel the emulsion by cooling and washing with cold water; (3) desalting with an ultrafiltration film; (4) desalting by electrodialysis; (5) desalting with the use of a centrifuge or liquid cyclone; and (6) desalting by combining two or more methods (1) to (5).

When the aforesaid method (1) is carried out in a large scale vessel, the sedimentation usually requires a long period of time, compared with the case of a small scale vessel. This is because the emulsion near the surface must move a longer distance for sedimentation until it reaches the bottom of the vessel. The prolonged sedimentation period is undesirable, since a change in the performance of the AgX emulsion may occur during the sedimentation step and the production time is also prolonged. When method (1) is performed in the middle scale vessel (II), this becomes less serious. However the sedimentation time in this case is somewhat long, compared with using a small scale vessel. A shorter sedimentation time is more desirable. This may be achieved by reducing the depth of the vessel. It is theoretically said that the same sedimentation time in a small scale vessel can be achieved even in a large scale vessel by reducing the depth of the vessel to the same level as that of the small scale one. The loss in the capacity of the vessel thus caused may be made up by enlarging the horizontal area of the vessel or by piling such shallow vessels on each other. The depth of water preferably range from 100 to 10 cm, more preferably from 60 to 20 cm. This sedimentation and water-washing steps may be carried out in branched apparatuses as shown by $D_2$ and $D_3$ of FIG. 5 to accept the required sedimentation time for each emulsion.

In method (2), the emulsion is gelled by cooling and then finely divided in a cubic, noodle-like or fine noodle-like form. Then it is desalted by washing with water in cold water. Generally speaking, the desalting rate is elevated as ratio of the surface/volume of the finely divided emulsion is increased.

Examples of method (3), wherein a porous film having a pore size smaller than the diameter of the AgX grains is used, include:

(a) a desalting method by repeating a procedure of applying pressure on the emulsion side, removing the aqueous solution from the emulsion and adding water to the emulsion;

(b) a desalting method by passing the emulsion through a fine hollow porous tube such as a hollow porous film and thus taking advantage of the concentration diffusion of the salt; and (c) a desalting method wherein methods (a) and (b) are combined.

In method (a), the desalting and concentration of the emulsion are effected. In method (b), on the other hand, scarcely any concentration is effected. In the latter case, therefore, a concentration step comprising, for example, vacuum deaeration dehydration may be added, if required. The accumulation of the emulsion thus concentrated on the surface of the porous film usually prevents subsequent dehydration. Accordingly, a dehydration step, wherein pressure is applied in parallel to the surface of the porous film and the emulsion flows in this direction so as to dehydrate the emulsion while removing the concentrated emulsion, is generally employed. When the porous film suffers from clogging, the porous film may be exchanged and the gelatin layer may be decomposed with an enzyme or hydrolyzed with an acid or an alkali followed by washing away the clogging matter. The AgX grains may be dissolved by using hypo, i.e., an AgX solvent and then washed away.

Method (4) is described in K. Ariga, *Journal of the Society of Photographic Science and Technology of Japan,* Vol. 31, 9 (1968) and *Kagaku Binran,* ed. by Society of Japan Chemical Society, Oyo Kagaku Hen II, 16-6, Maruzen (1986).

Figure 6A:
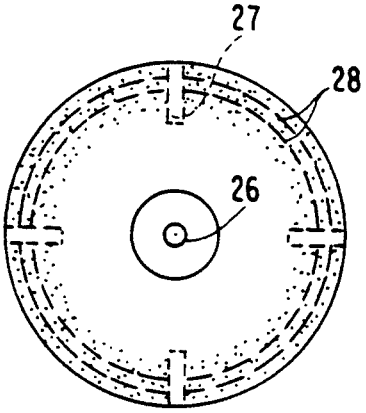
FIGS. 6A and 6B illustrates a centifugal washing vessel according to the present invention, wherein (a) is a top view and (b) is a side view.
Figure 6B:
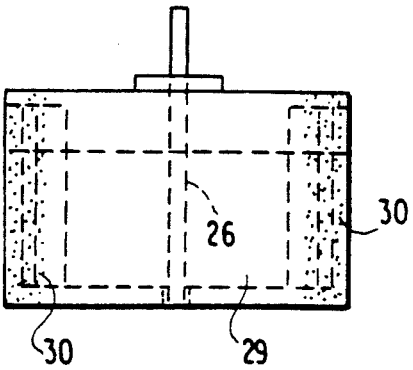

FIG. 6 shows an embodiment of method (5). In this case, a vessel and an AgX emulsion rotate around the rotating axis 26 located at the center of the vessel. A partition wall 27 is provided in order to elevate the rotation efficiency of the emulsion, since the emulsion and the vessel would rotate simultaneously. Further, two or more Teflon meshes 28 are provided in order to facilitate the redispersion of the grains. This apparatus turns just like the dehydrator of a washer to thereby separate the AgX emulsion 30 from water 29 by centrifugal force. The water thus separated is then removed with a pump of the type shown in FIG. 4. Next, water is added and the emulsion grains are dispersed again by vibrating the Teflon meshes. This procedure is repeated so as to complete the desalting.

This method enables desalting and concentration within the shortest period of time at a low cost. Further, the treatment time remains constant. Thus it is preferably employed in a system controlling system in the present invention.

In method (1), it is required to lower the pH value of the emulsion below the isoelectric point of gelatin (usually pH 3.8 to 4.5). On the other hand, methods (2) to (5) are free from such a requirement. In method (2) involving no step for concentrating the emulsion, it is required to add a concentration step comprising, for example, vacuum deaeration dehydration or ultrafiltration, if needed. Details of the methods (1) to (5) are described in G. F. Duffin, *Photographic Emulsion Chemistry,* Focal Press, London (1966); JP-B-43-27725 (The term "JP-B" as used herein means an "examined Japanese patent application"); U.S. Pat. Nos. 4,334,012, 4,336,328, 3,326,641, 3,881,934 and 3,396,027; British Patent No. 1,543,322; JP-A-62113137; *Research Disclosure,* Vol. 102, (Item 10208) (Oct., 1972), ibid., Vol. 131 (Item 13122) (Mar., 1975) and ibid., Vol. 176 (Item 17643) (Dec., 1978); K. Ariga, *Journal of the Society of Photographic Science and TEchnology of Japan,* Vol. 431, 9 (1968); and *Kagaku Binran,* ed. by Japanese Chemical Society, Oyo Kagaku hen II, 16-6, Maruzen (1986). Further, the porous film is described in Japanese Patent Application No. Hei-1-76678.

In a study for the improvement of an AgX emulsion, the chemical sensitization step of the AgX emulsion is usually performed in a batch reaction apparatus. When a new AgX emulsion is produced in a plant, therefore, it is preferable that chemical ripening step is carried out under conditions similar to those employed in experimental research, and as close as possible. In the case of the apparatus of the present invention, therefore, it is preferred that the AgX emulsion supplied from the desalting and concentration step is subjected to chemical sensitization in a batch reaction apparatus.

The chemical sensitization time varies depending on the type of the emulsion and temperature. Usually, it may be performed for 10 to 70 minutes following the addition of a chemical sensitizing agent. When chemical ripening is to be carried out for a long period of time, the chemical ripening step may be divided into two or more stages depending on the chemical ripening time. Alternately, branched reaction apparatuses may be used, as shown in FIG. 5.

The solution of the chemical sensitizing agent may be preferably added directly to the AgX emulsion (namely, added directly under the liquid surface) and then quickly stirred with stirring blades provided near the inlet port. It is further preferred to add the sensitizing solution through the porous material. Regarding the addition system and stirring blades, the above-described description relating to the reaction vessels may be referred to. That is, a reaction vessel the same form as those used in the AgX grain forming reaction may be preferably employed.

Furthermore, the chemical sensitization may be carried out in a state where one or more chemical sensitization modifiers (for example, sensitizing dye, antifoggant, sensitizing dye/antifoggant conjugate) are adsorbed by AgX grains to thereby control the formation site of chemical sensitization nuclei and the number thereof per $cm^2$. The chemical sensitization modifier(s) may be added at any point 3 or more minutes before the completion of the chemical sensitization step.

This chemical sensitization method is particularly preferred, since it makes it possible to shorten the chemical ripening period (usually from 3 to 15 minutes). This method, is described in Japanese Patent Application No. Sho-63-315741, No. Sho-63-223739 and No. Hei-1-90089 may be referred to.

The term "photographic additives" as used herein includes optical sensitization dyes, antifoggants, dye image-forming agents. When these additives are added in the form of solutions, middle scale apparatuses the same form as those employed in the AgX grain forming reaction and chemical synthesization may be used. The capacities of the middle scale apparatuses and the large scale apparatus used in the water-washing step, chemical synthesization step and this photographic additives addition step are shown in Table 1. A photographic additive such as a dye image-forming agent may be added in the form of an oily solution (i.e., emulsification/dispersion adding), as described in JP-A-63-296035, Japanese Patent Application No. Hei-1-76678.

According to the present invention, a combination of the process stages for desalting, and chemical sensitizing silver halide grains and adding photographic additives in the silver halide emulsion may be addapted from the following three embodiments depending on an amount of the solution.

In the scheme, "large" and "middle" in parentheses mean that "large scale apparatus" and "middle scale apparatus", respectively, is used in each process stage.

(1) Desalting AgX (large)→Chemical Sensitizing AgX (large)→AddingpPhotographic additives (large)→Coating emulaion (2) Desalting AgX (middle)→Chemical Sensitizing AgX (large)→Adding photographic additives (large)→Coating emulsion (3) Desalting AgX (middle)→Chemical Sensitizing AgX (middle)→Adding photographic additives (middle)→Coating emulsion It should be noted that a reservation stage may be interposed after any stage between AgX preparation and coating emulsion stages, and the desalting AgX stage may be reversed by the chemical sensitizing AgX stage. Further, each stages may preferably be carried out in the separate apparatuses connected in series.

In the most preferred embodiment of the production of a photographic light-sensitive material by using the apparatus of the present invention, all of these steps are continuously carried out in middle scale vessels and the emulsion thus produced continuously is continuously coated. Namely, all steps are continuously and automatically conducted without an intermediate refrigerator storage step. When one or two AgX emulsions are to be applied onto a single substrate, for example, in the case of an X-ray photographic film, one or two systems for the production of the AgX emulsions and a coating step are jointly controlled. In this case, the control can be economically effected, which makes fully-automatic unmanned continuous production possible. When seven to ten AgX emulsions are to be simultaneously coated onto a single substrate (e.g., in the case of a color negative photographic film), on the other hand, it is necessary to set seven to ten systems for the production of the AgX emulsions in order to coordinate the AgX emulsion production with the coating step, which is disadvantageous from an economical viewpoint. When one of these systems is out of order, furthermore, the whole apparatus must be stopped, thus causing serious inefficientcy. In this case, it is therefore preferred to conduct the coating after producing all of the emulsions. Thus some of the emulsions may be stored in a refrigerator, if required. When a large amount of an emulsion is produced, according to a batch type chemical sensitization it is preferable to divide said emulsion into small portions and store in a refrigerator.

A "system controlling apparatus" as used in the present invention means a controlling system whereby controlling operations, for example, switching of each valve, start and stop of stirring, measuring and addition of a solution, start and stop of controlled double jet (C.D.J.) method are successively and systematically carried out in accordance with a predetermined sequence and time schedule. A conventional controlling system may be used therefor. Details thereof are described in *Sequence Jido Seigyo Binran,* supervised by Z. Sawai, Ohm K.K. (1971).

Each of the aforesaid mid-scale apparatuses is normally provided with a temperature controlling apparatus. The temperature in the production of an AgX emulsion generally ranges from 15° to 90° C. and water has a large heat capacity. Therefore water is employed as a heat exchange medium. For example, a reaction vessel can be provided with an external jacket through which a heat medium is passed to thereby control temperature. Furthermore, a pipe may be introduced into a reaction solution and a heat exchange medium circulated through it. Alternately, the reaction vessel may be heated either from the external wall side or from the inside of the reaction solution through electric resistance heating, hot plate heating, infrared (hot wire) heating or eddy current heating. Regarding the temperature control, in addition, *Jikken Guidebook,* ed. by Japanese Chemical Society, 3-2-3 to 3-2-4, Maruzen (1984); *Shin Jikken Kagaku Koza I* (Kihon Sousa I, 2-2), Maruzen (1975); and *Kagaku Sochi Binran,* ed. by Society of Chemical Technology, Chap. 14, Maruzen (1989) may be referred to. Controlling systems, for the temperature control and the P.I.D. controlling system of controlled double jet (C.D.J.) method, are described in *Kagaku Sochi Binran,* ed. by Society of Chemical Technology, chap. 21, Maruzen (1989).

As the addition system for the aqueous silver salt solution and aqueous halide solution, a system for adding via an orifice or a needle valve under air or nitrogen gas pressure, or an addition system with the use of a diaphragm pump or a plunger pump, as shown in FIG. 4(*a*) or (*c*), may be employed. In addition, methods described in JP-A-62-182623 and JP-A-1-199123 and in *Kagaku Kogaku Binran,* ed. by Society of Chemical Technology, section 5-6-5, Maruzen (1988) and *Kagaku Sochi Hyakkajiten,* chap. 1, Kagaku Kogyo Sha (1976) may be used. In principle, a digital-type flow rate controlling system is more accurate than an analog system, as described in JP-A-62-182623. Further, the diaphragm pump and plunger pump are preferred from the viewpoint of convenience, since the piston operation directly contributes to the addition and measurement of the solutions.

It is usually preferred that the system components contacted with the AgX emulsion are made of a material exerting no undesirable effect on the AgX emulsion. Generally, they may be made of stainless steel (SUS 316, 316L or 329J), hard glass or polymer materials such as polyethylene, polypropylene or Teflon. Alternately, a composite material (for example, Teflon-coated stainless steel) may be used therefor.

In the case of the check valves, the ball of a ball-type lift valve or a swing of a swing-type valve may be made of, for example, Teflon or polyethylene. Upon the switching of a valve, it is preferred to smoothly conduct the pumping so as to avoid any serious impact on the emulsion in the switch part.

In addition to the production of AgX emulsion grains, the apparatus of the present invention may be used for common chemical reactions of the same type as the AgX emulsion grain formation reaction. Conventional apparatuses for chemical reactions may be classified into: (1) batch apparatuses, (2) semi-batch apparatuses and (3) continuous apparatuses (a. tube type, b. tank type and c. multiple stage tank type), as described in *Kagaku Kogaku Binran,* ed. by Society of Chemical Technology, chap. 23, Maruzen (1988). However, no apparatus of the operation type of the present invention (i.e., continuous multistage batch system) is described in this publication.

As the dispersion medium to be used in the production of an AgX emulsion by using the apparatus of the present invention, any dispersion media which are conventionally used for AgX emulsions, such as gelatin and various kinds of hydrophilic colloids, can be used. Among these media, gelatin is usually employed. As gelatin, alkali-treated gelatin, acid-treated gelatin, gelatin derivatives such as phthalated gelatin, low molecular weight gelatin (molecular weight: from 2,000 to 100,000, such as enzyme-decomposed gelatin and gelatin hydrolyzed with an acid or an alkali) and gelatin containing 50 μmol/g or less of methionine (described in JP-A-62-157024) may be used. Further, a mixture thereof may be used. Examples of the gelatin derivatives include products obtained by reacting gelatin with various compounds such as acid halides, acid anhydrides, isocyanates, bromoacetic acid, alkanesultones, vinylsulnfoamides, maleinimide compounds, polyalkylene oxides and epoxy compounds. Other examples of the dispersion medium to be used in the present invention are graft polymers of gelatin and other polymers; thioether polymers; proteins such as albumin and casein; cellulose derivatives such as hydroxyethyl cellulose, carboxymethyl cellulose and cellulose sulfate; sugar derivatives such as sodium alginate and starch derivatives; and various synthetic hydrophilic high molecular weight substances of homopolymers or copolymers such as polyvinyl alcohol, polyvinyl alcohol partial acetal, poly-N-vinyl-pyrrolidone, polyacrylic acid, polymethacrylic acid, polyacrylamide, polyvinyl imidazole and polyvinyl pyrazole. Any one of these substances or a mixture thereof may be used.

Details of these dispersion media are described in the literature listed below.

In the present invention, a silver halide solvent can be used for controlling the supersaturation of the solute concentration during the nucleation of the AgX grains, for accelerating ripening in the ripening step, for accelerating the growth of crystals in the crystal growth step and, in particular, for effectively performing the chemical sensitization of the silver halide emulsion.

Examples of the silver halide solvent include thiocyanates, ammonia, thioethers and thioureas. These materials are also described in the literature listed below.

There is no particular restriction on the additives which can be added to the silver halide emulsion in any step from the formation of the silver halide grains to the coating of the emulsion. Examples of additives which can be used in the present invention are silver halide solvents (ripening accelerator), dopants for silver halide grains (for example, compounds of noble metals belonging to Group VIII of the Periodic Table such as platinum and palladium, compounds of other metals such as gold, iron, lead, cadmium, chalcogen compounds and SCN compounds), dispersion media, antifoggants, stabilizers, sensitizing dyes (for example, for blue sensitization, green sensitization, red sensitization, infrared sensitization, panchromatic sensitization and orthochromatic sensitization), super sensitizers, chemical sensitizers (chemical sensitizers such as the compounds of sulfur, selenium, tellurium, gold and noble metals of Group VIII, and phosphorus compounds, either as a single compound or a combination thereof, most preferably, chemical sensitizers composed of a combination of compounds of gold, sulfur and selenium and reduction sensitizers such as stanneous chloride, thiourea dioxide, polyamine and amineborane series compounds), fogging agents (organic fogging agents such as hydrazine series compounds and inorganic fogging agents), surfactants (for example, defoaming agents), emulsion sedimenting agents, soluble silver salts (for example, AgSCN, silver phosphate, silver acetate), latent image stabilizers, pressure desensitization inhibitors, viscosity-increasing agents, hardening agents, developing agents (for example, hydroquionine series compounds) and development modifiers. Specific compounds of these additives and methods of using them are described in the following literature.

Furthermore, the AgX emulsion can use any combination of the conventional techniques and conventional compounds described in the following literature.

*Research Disclosure* Vol. 176 (Item 17643) (Dec. 1978), ibid., Vol. 184 (Item 18431) (Aug., 1979), ibid., Vol. 216 (Item 21728) (May, 1982), *Journal of Nikka Kyo,* 12, 18–27 (1984), *Journal of Society of Photographic Science and Technology of Japan,* Vol. 49, 7 (1986), ibid., Vol. 52, 144–166 (1989), JP-A-58-113926, JP-A-58-113927, JP-A-58-113928, JP-A-59-90842, JP-A-59-142539, JP-A-62-253159, JP-A-62-99751, JP-A-63-151618, JP-A-62-6251, JP-A-62-115035, JP-A-63-305343, JP-A-62-269958, JP-A-61-112142, JP-A-62-266538, JP-A-63-220238, JP-A-63-78465, JP-A-1-131541, JP-A-1-297649, JP-A-2-146033, JP-A-2-838, Japanese Patent Application Nos., Sho-62-208241 and Sho-63-311518, JP-B-59-43727, U.S. Pat. Nos. 4,705,744, 4,707,436, T. H. James, *The Theory of The Photographic Process,* (Fourth Edition, Macmillan, New York, 1977), V. L. Zelikman et al., *Making and Coating Photographic Emulsion* (The Focal Press, 1964), P. Glafkides, *Chimie et Physiques Photographigues,* (Fifth Edition de l'Usine Nouvelle, Paris, 1987), ibid., (Second Edition, Paul Montel, Paris, 1957), and K. R. Hoilister, *Journal of Image. Sci.,* 31, 148–156 (1987).

The invention is now described in greater detail with reference to the following examples and specific embodiments, which are not to be construed as limiting the present invention in any way. Unless otherwise indicated, all parts, percents and ratios are by weight.

COMPARATIVE EXAMPLE 1

Tabular AgX emulsion grains having parallel twin planes were produced by using a small scale apparatus for experimental research having the same form as that of the small scale apparatus of FIG. 1 and a vessel capacity of 4 liters. First, an aqueous gelatin solution ($H_2O$ 11, 7 g of gelatin of average molecular weight (M) 20,000, pH 6.0, KBr 4.5 g) was added to the reaction vessel and the temperature was kept at 30° C. Then 27.5 ml portions of an aqueous $AgNO_3$ solution (containing 32 g of $AgNO_3$, 0.7 g of gelatin (M=20,000) and 0.2 ml of $HNO_3$ (1N) per 100 ml) and an aqueous KBr solution (containing 23.2 g of KBr and 0.7 g of gelatin (M=20,000) per 100 ml) were simultaneously added thereto by a double jet method each at a rate of 25 ml/minute under stirring. After 1 minute, 197 ml of an aqueous solution of gelatin (containing 32 g of deionized and alkali-treated gelatin, pH=6.5) was added and the obtained mixture was uniformly stirred for one minute. Then it was heated to 75° C. within 10 minutes. After performing ripening for 15 minutes, 27 ml of an aqueous $AgNO_3$ solution (15% by weight) was added thereto within 3 minutes. Next, a mixture containing 10 ml of a $NH_3$ solution (25% by weight) and 10 ml of a $NH_4NO_3$ solution (50% by weight) was added thereto followed by ripening for 21 minutes. Then the pH value of the reaction mixture was adjusted to 5.5 by adding a 3N $HNO_3$ solution. Further, 10 ml of an aqueous KBr solution (10% by weight) was added. Then an aqueous $AgNO_3$ solution (15% by weight) and an aqueous KBR solution (11% by weight) were added by a controlled double jet method at a rate of 8 ml/minute at a silver potential of 20 mV (vs. saturated calomel electrode) for 10 minutes. Further, the $AgNO_3$ solution was added to thereby adjust the silver potential to +5 mV.

Next, an $AgNO_3$ solution (15% by weight) and a X− solution (containing 56 g of KBr and 9 g of KI in 654 ml of the solution) were added by a controlled double jet method at a silver potential of 5 mV. The addition was performed by a linear acceleration method wherein the initial flow rate, i.e., 4 ml/minute of each solution was accelerated at a rate of 0.37 ml/minute for 46 min total. Then an aqueous KBr solution (15% by weight) was added to the emulsion to thereby adjust the silver potential to −50 mV. Then an aqueous $AgNO_3$ solution (15% by weight) and an aqueous KBr solution (11% by weight) were added by a controlled double jet method at a rate of 20 ml/minute for 8 minutes. After stirring the emulsion for 3 minutes, a sedimenting agent was added and the temperature was adjusted to 30° C. Accordingly, the process for producing the AgX emulsion, i.e., starting from the formation of AgX nuclei to the addition of the sedimenting agent required 120 minutes and 0.735 mol of tabular AgX emulsion grains were fed into the following water washing step in the same vessel.

Nitric acid was added to the emulsion to thereby adjust the pH value to 4.1. Then the stirring was ceased and the emulsion was sedimented. The supernatant was removed and 2800 ml of water was added. After stirring, the emulsion was washed with water and the stirring was ceased. Thus the emulsion was sedimented again. This procedure was repeated again and then the temperature was elevated to 40° C. An aqueous gelatin solution ($H_2O$ 700 ml, bone gelatin 70 g) was added and dispersed again, thus giving a yield of 1.1 liters.

The properties of the hexagonal tabular emulsion grains thus obtained determined from the transmission type electron microphotographic (TEM) image of the replica are shown in Table 1.

Next, the AgX emulsion was heated to 55° C., and 5,5'-dichloro-9-ethyl-3,3'-bis(3-sulfopropyl)-oxacarbocyanine Na salt, in an amount of 83% of the saturated adsorption, was added. After 10 minutes, $1.1\times10^{-5}$ mol/mol of AgX of an aqueous sodium thiosulfate solution was added followed $3\times10^{-4}$ mol/mol of AgX of KSCN. After 2 minutes, $8\times10^{-6}$ mol/mol of AgX of an aqueous chloroauric acid solution was added followed by ripening for 15 minutes.

Next, the emulsion was heated to 40° C. and $7\times10^{-3}$ mol/mol of AgX of an antifoggant (TAI (4-hydroxy-6-methyl-1,3,3a,7-tetraazaindene)) was added. After 10 minutes, 250 ml of an aqueous gelatin solution (10% by weight), 26 ml of a 1% by weight solution of a coating aid (sodium dodecylbenzenesulfonate), 26 ml of a 2% by weight solution of a thickener (poly(4-sufostyrene) sodium salt) and g of a hardening agent were added. The obtained mixture was applied, together with a gelatin protective layer, on a transparent cellulose triacetate base at a rate of 2 g of silver/$m^2$ and dried. In this case, all of the AgX emulsion grain formation step, the water washing step, the chemical sensitization step and the additives addition step were conducted in a single mid-scale vessel.

COMPARATIVE EXAMPLE 2

Each step of the above Comparative Example 1 was conducted on a scale 250 times larger, by using a large scale apparatus having the same form as the one used in Comparative Example 1 and a vessel capacity of 960 liters. The TEM image of the replica of the obtained emulsion grains was observed. Table 1 shows the results. Table 1 shows that the grain size distribution of said grains was enlarged and the ratio of hexagonal tabular emulsion grains was substantially lowered. The procedure from the setting of the reaction solution to the addition of the additives required approximately 135 minutes and approximately 184 mol of tabular AgX emulsion grains were thus obtained. An additional 10 minutes were required in order to elevate the temperature from 30° C. to 75° C. Then the obtained emulsion was treated in a large scale vessel in the same manner as the one described in Comparative Example 1 and applied, together with the gelatin protective layer, ion a transparent cellulose triacetate base at a rate of 2 g of silver/$m^2$, followed by drying.

EXAMPLE 1

By using the apparatus comprising 8 vessels of $A_1$, $A_2$, B, C, D, E, F and G which were placed in a manner according FIG. 5, the AgX emulsion of the same formulation as the one described in Comparative Example 1 was continuously produced on a mass scale. Two apparatuses of a vessel capacity of 20 liters ($A_1$ and $A_2$) were employed for the nucleation while apparatuses C to G (vessel capacity: B, C, D=150 liters, E=180 liters, F, G=250 liters) were used for the ripening and crystal growth. The nucleation step was performed on a scale 12 times that of Comparative Example 1, while the ripening and crystal growth steps were each performed on a scale 72 times that of Comparative Example 1. The concentration of each added solution was the same as the corresponding solution described in Comparative Example 1. The transfer of each reaction solution and shower washing were completed within 1 minute.

The vessel temperatures of $A_1$, $A_2$ and B were maintained at 30° C. and those of C to F were maintained at 75° C. Each step was repeated at intervals of 31 minutes. Each switching operation was performed within 7 seconds.

First, two middle scale vessels of a capacity of 20 liters were used and the nucleation was performed in each of these vessels on a scale 12 times that of Comparative Example 1. Namely, an aqueous gelatin solution (12 liters of $H_2O$, 84 g of gelatin (M=20,000), pH 6.0, 54 g of KBr) at 30° C. was introduced within 20 seconds and the mixture was stirred for 4 minutes and 30 seconds while maintaining the temperature at 30° C. Next, 330 ml portions of an aqueous $AgNO_3$ solution and an aqueous KBr solution were simultaneously added thereto at a rate of 300 ml/minute by a double jet method. After 1 minute, the reaction solution was transferred into vessel B, to which 14,184 ml of a gelatin solution had been preliminarily introduced and stirred. After the liquid transfer, vessels $A_1$ and $A_2$ were washed with a water shower for 1 minute and the washing water was discarded. Thus 8 minutes and 56 seconds were required in total. After repeating each step three times, nuclei 72 times the amount of Comparative Example 1 were stored in the vessel B (the amount of the reaction solution: 90.144 liters). This procedure was repeated at intervals of 31 minutes.

After transferring the solution in B into C, 14,184 ml of an aqueous gelatin solution was added to B within 30 seconds to be used in the subsequent cycle. After the liquid transfer, the reaction solution in C was stirred for 22 minutes and 1,944 ml of an aqueous $AgNO_3$ solution was added thereto in three portions within 3 minutes. After 1 minute, the reaction solution was transferred into vessel D. Then vessel C was washed with a water shower for 1 minute and the washing water was discarded, after which vessel C remained empty until transfer of the next batch from vessel B.

After the liquid transfer, the reaction solution in D was stirred for 30 seconds. Then a mixture containing 720 ml of $NH_4NO_3$ and 720 ml of an aqueous $NH_3$ solution was directly added under the liquid surface within 30 seconds. After ripening for 21 minutes, 2,520 ml of a 3N aqueous $HNO_3$ solution was added under the liquid surface within 30 seconds to thereby adjust the pH value of the reaction solution to 6.5. After 30 seconds, 720 ml of an aqueous KBr solution was added into the mixing vessel within 30 minutes. After stirring for 2 minutes, the reaction solution was transferred into vessel E. Next, vessel D was washed with a water shower for 1 minute and then the washing water was discarded, after which vessel D remained empty unit receiving the next batch from vessel C.

After the liquid transfer, the reaction solution in E was stirred for 30 seconds and then an aqueous $AgNO_3$ solution and an aqueous KBr solution were added thereto within 10 minutes at a rate of 576 ml/minute by a controlled double jet method at a silver potential of $-20$ mV. Then the $AgNO_3$ solution was further added alone so as to adjust the silver potential to $+5$ mV. After stirring for 30 seconds, an aqueous $AgNO_3$ solution and an aqueous $X^-$ salt solution were added at a silver potential of 5 mV by a controlled double jet method wherein the initial flow rate, i.e., 288 ml/minute was accelerated at a rate of 26.4 ml/minute, for 13 minutes. After the addition, the reaction solution was stirred for 1 minute and then transferred into vessel F. Then vessel E was washed with a water shower and the washing water was discarded, after which vessel E remained empty until the next cycle.

The reaction solution in F was stirred for 30 seconds and then an aqueous $AgNO_3$ solution and an aqueous $X^-$ salt solution were added by a controlled double jet method, wherein the initial flow rate, i.e., 632.32 ml/minute was accelerated at a rate of 26.64 mg/minute, for 26 minutes at a silver potential of 5 mV. After stirring for 30 seconds, the reaction solution was transferred to vessel G. Then the vessel F was washed with a water shower for 1 minute and the washing water was discarded, after which vessel F remained empty until the next cycle.

In the vessel G, the reaction solution was stirred for 30 seconds and then an aqueous $AgNO_3$ solution and an aqueous $X^-$ salt solution were added by a controlled double jet method, wherein the initial flow rate, i.e., 1,326.96 ml/minute was accelerated at a rate of 26.64 ml/minute, for 4 minutes. After the addition, the reaction solution was stirred for 30 seconds and then an aqueous KBr solution was added to thereby adjust the silver potential to $-50$ mV. After 30 seconds, an aqueous $AgNO_3$ solution and a KBr solution were added by a controlled double jet method ($-50$ mV) at a rate of 1,440 ml/minute for 8 minutes. After the addition, the reaction solution was stirred for 3 minutes and then transferred into a separate water-washing vessel. Then the vessel G was washed with a water shower for 1 minute and the washing water was discarded, after which vessel G remained empty until the next cycle.

In this case, tabular AgX emulsion grains were formed at a rate of 52.92 mol every 31 minutes (211.67 mol/124 minutes), which indicates that high performance AgX grains were produced by using the middle scale apparatus at a higher productivity than achieved in Comparative Example 2 (refer to Table 2), showing the superiority of the present invention.

The water-washing (desalting) vessel was a flat-bottomed cylindrical container (diameter: approximately 88 cm) having a depth of 50 cm and a capacity of 300 liters. It was maintained at a temperature of 30° C. After the liquid transfer, the reaction solution was stirred for 30 seconds and then a sedimenting agent was added thereto. After 10 minutes, nitric acid was added to thereby adjust the pH value to 4.1. After 5 minutes, the stirring was ceased and the emulsion was sedimented within approximately 13 minutes. The supernatant was sucked up with the suction pump of FIG. 4 (*b*) and removed. Next, 200 liters of water was added thereto. After stirring for 5 minutes, the stirring was ceased and the emulsion was sedimented within approximately 13 minutes. After repeating this procedure once, the temperature was elevated to 40° C. and an aqueous gelatin solution was added within 10 minutes so as to disperse the emulsion again. Thus a yield of 79.2 liters was achieved. The emulsion was transferred into a chemical ripening vessel and the water-washing vessel was washed with a water shower. Then the washing water was discarded, and the water-washing vessel remained empty until the next batch. The process required 80 minutes in total. Table 1 shows the properties of the emulsion grains thus obtained determined from the TM image of the replica. These properties corresponded well to the results obtained by using the small scale apparatus for experimental research.

The effect achieved by reducing the capacity of the nucleation vessel (20 liters/960 liters=1/48) particularly contributed to these results. As FIG. 5 D shows, three branched vessels were provided as the water-washing vessels. Each apparatus was operated at intervals of 93 minutes.

For the chemical ripening vessel, two branched vessels having a capacity of 120 liters were provided. These vessels were maintained at a temperature of 55° C. After the liquid transfer, the reaction solution was stirred for 10 minutes and then subjected to chemical sensitization on a scale 72 times that the one of Comparative Example 1. Then the reaction solution was transferred into the next addition step vessel. Each apparatus was operated at intervals of 62 minutes.

The addition step vessel had a capacity of 120 liters and was maintained at a temperature of 40° C. After the liquid transfer, the reaction solution was stirred for 10 minutes and then the same additives as those used in Comparative Example 1, each in an amount 72 times as much as used in Comparative Example 1, were added, followed by transfer into the next coating step.

In the coating step, the reaction solution was applied, together with the gelatin protective layer, onto a transparent cellulose triacetate base at a ratio of 2 g of silver/$m^2$ and dried.

EXAMPLE 2

The process for producing an AgX emulsion described in Comparative Example 1 was continuously performed on a mass scale by using the apparatus of FIG. 1. The reaction vessels 2A, 2B and 2C respectively had capacities of 180 liters, 250 liters and 320 liters. For the addition of an $AgNO_3$ solution and an $X^-$ salt solution, separate hollow tube porous film addition system (Teflon tube provided with 8,000 pores of 0.15 mm in diameter at a rate of a pore per 2.5 $mm^2$) were employed. Each step was performed on a scale 85 times as large as that of Comparative Example 1. The concentration of each solution added was the same as that of Comparative Example 1. The transfer and shower-washing of each reaction solution were completed each within 1 minute. Each step was repeated at intervals of 50 minutes. First, an aqueous gelatin solution (85 liters of $H_2O$, 595 g of gelatin (M=20,000, ph 6.0), and 382.5 g of KBr) at 30° C. was introduced into the vessel 2A within 30 seconds and stirred for 4 minutes and 30 seconds while maintaining at 30° C. Next, nucleation was conducted on a scale 85 times as large as that of Comparative Example 1. After adding a gelatin solution, the temperature was elevated to 75° C. within approximately 15 minutes. After elevating the temperature and ripening for 15 minutes, an aqueous $AgNO_3$ solution was added thereto. After stirring for an additional 2 minutes, the stirring was ceased and the solution in 2A was transferred into 2B. After the liquid transfer, the valve 11 was switched and the vessel 2A was washed with a water shower. The washing water was then discarded. After closing the valve, the temperature of the reaction vessel was lowered to 30° C., followed by standing until the next cycle. Thus 50 minutes, including the standing period, were required in total.

On the other hand, vessel 2B was continuously maintained at 75° C. and the reaction solution transferred thereto was stirred. After 1 minute, an $NH_4NO_3$ solution and an $NH_3$ solutions were added and the mixture was ripened for 21 minutes Then an $HNO_3$ solution (3N) was added and the pH value was adjusted to 5.5, followed by further adding a KBr solution. Then an $AgNO_3$ solution and a KBr solution were added by a controlled double jet method at a silver potential of −20 mV for 10 minutes. Next, an $AgNO_3$ solution and an $X^-$ salt solution were added by the controlled double jet method at a silver potential of 5 mV, wherein the initial flow rate, i.e., 340 ml/minute was accelerated at a rate of 31.45 ml/minute. After the addition, the reaction mixture was stirred for 1 minute and then transferred into vessel 2C. Next, the vessel 2B was washed with a warm water shower for 1 minute and the washing water was discarded, followed by standing until the next cycle. Thus 50 minutes, including the standing period, were required in total.

Vessel 2C was continuously maintained at 75° C. The transferred reaction solution was stirred. After 1 minute, the same $AgNO_3$ solution and the $X^-$ salt solution were added by the same described controlled double jet method, wherein the initial flow rate, i.e., 654.5 ml/minute was accelerated at a rate of 31.45 ml/minute. Next, a KBr solution was added and the silver potential was adjusted to −50 mV. The $AgNO_3$ solution and the KBr solution were added by a controlled double jet method at a silver potential of −50 mV for 8 minutes. After the addition, the reaction solution was stirred for 2 minutes and then transferred into a cooling vessel 2D. The vessel 2C was washed with a warm water shower for 1 minute and the washing water was discarded, followed by standing until the next cycle. Thus 50 minutes, including the standing period, were required in total.

The vessel 2D was continuously maintained at 35° C. When the emulsion was cooled to 38° C. or below, the emulsion was transferred into a water-washing vessel 2E of FIG. 6 having a capacity of 360 liters (depth: 50 cm, radius=50 cm). In this apparatus, the emulsion was centrifuged and the water thus separated was removed by using a pump of FIG. 4 (b). Next, 230 l of washing water was added and the Teflon mesh was vibrated to thereby disperse the separated emulsion again. The emulsion was then centrifuged again. Next, an aqueous gelatin solution was added and the emulsion was dispersed again and then transferred into a chemical ripening vessel 2F. The yield of the emulsion was 93.5 liters. The 2D and 2E steps required 50 minutes in total. The properties of the emulsion grains thus obtained determined from the TEM image of the replica are shown in Table 2. As Table 2 shows, the properties of the emulsion grains were more closely similar to those produced by using the small scale apparatus, than the ones obtained in Comparative Example 2. This is because the capacity of the nucleation vessel was reduced from 960 liters (Comparative Example 2) to 180 liters and the porous film addition system was employed.

Vessel 2F was continuously maintained at 55° C. and had a capacity of 150 liters. After the liquid transfer, the reaction solution was stirred for 10 minutes and addition solutions were added each in an amount 85 times as much as the corresponding one described in Comparative Example 1, thus performing chemical ripening. Then the temperature was lowered to 40° C. and an antifoggant, an aqueous gelatin solution, a coating aid, a thickener and a hardener were added. The obtained mixture was transferred into the coating step. This procedure was conducted at intervals of 50 minutes.

In the coating step, the reaction solution was applied, together with the gelatin protective layer, on a transparent cellulose triacetate base at a ratio of 2 g of silver per $m^2$ followed by drying.

The samples obtained in Comparative Examples 1 and 2 and Examples 1 and 2 were subjected to wedge exposure with blue light for 1/10 second using a tungsten light source (5400° K.) provided with a interference filter of 419 nm. Next, each sample was developed with the following developing solution D-1 at 20° C. for 4 minutes and fixed with a fixing solution F-1, followed by washing with water and drying. Table 2 shows the results of sensitometry. As Table 2 shows, the results of Example 1 well correspond to those of Comparative Example 1, from the viewpoint of performance.

| | |
|---|---|
| (Developing solution D-1) | |
| 1-phenyl-3-pyrazolidone | 0.5 g |
| hydroquinone | 20.0 g |
| disodium ethylenediaminetetraacetate | 2.0 g |
| potassium sulfite | 60.0 g |
| boric acid | 4.0 g |
| potassium carbonate | 20.0 g |
| sodium bromide | 5.0 g |
| diethylene glycol | 30.0 g |
| Water was added to the above composition to thereby adjust the total volume to 1 liter. (The pH value was adjusted to 10.0). | |
| (Fixing solution F-1) | |
| ammonium thiosulfate | 200.0 g |
| sodium sulfite (anhydrous) | 20.0 g |
| boric acid | 8.0 g |
| disodium ethylenediaminetetraacetate | 0.1 g |
| aluminum sulfate | 15.0 g |
| sulfuric acid | 2.0 g |
| glacial acetic acid | 22.0 g |

-continued

Water was added to the above composition to thereby adjust the total volume to 1 liter. (The pH value was adjusted to 4.2).

TABLE 2

| | C. Ex. 1 | C. Ex. 2 | Ex. 1 | Ex. 2 |
|---|---|---|---|---|
| Mean projected Grain Size of tabular Grain (μm) | 1.47 | 1.42 | 1.47 | 1.47 |
| Mean Thickness of Tabular Grain (μm) | 0.21 | 0.23 | 0.21 | 0.21 |
| Mean Aspect Ratio of Tabular Grain | 7.0 | 6.17 | 7.0 | 7.0 |
| C.V. of Mean Grain Size Distribution of Tabular Grain (%) | 13.0 | 17.5 | 13.5 | 13.3 |
| Areal Ratio Occupied by Hexagonal Tabular Grains in Whole Tabular Grains (%) | 99.8 | 96.0 | 99.7 | 99.7 |
| Relative Sensitivity of Emulsion Coating | 100 | 92 | 100 | 100 |
| Fogging of Emulsion Coating | 0.1 | 0.18 | 0.1 | 0.1 |

As described above, the process for producing a silver halide emulsion using the apparatus therefor according to the present invention provides the following unexpected advantages:

(1) An emulsion of the same characteristics as those of an improved emulsion produced by using a small scale apparatus for experimental research can be produced on an industrial scale. It is particularly effective, in the production of monodisperse tabular emulsion grains having a high ratio of tabular emulsion grains, to use a nucleation reaction vessel of a reduced size.

(2) The average staying times of the emulsion grains in reaction vessels are the same, which makes it possible to produce emulsion grains of good monodispersibility.

(3) The average grain size of the emulsion grains may be effectively controlled.

(4) The emulsion for the use of small-scale-commercial-products may be produced by controlling the continuous production time, if required, which makes it possible to avoid over production.

(5) A emulsion such as those described above can be continuously produced in a required amount with good reproducibility. When the water-washing step, the chemical sensitization step, the addition step and the coating step are seriesed with each other, the whole process from AgX grain formation to coating, can be fully automatically performed. Thus the refrigerator storage step and the thawing step can be omitted, which makes it possible to lower the production cost.

(6) Each apparatus has a specialized single function and a mid-size, which makes it possible to improve the control of performance and to easily automate the process. Thus equipment of high accuracy can be obtained.

(7) Each apparatus has a specialized single function and a mid-size and thus the equipment has a high operating efficiency. Thus the equipment cost of the whole apparatus can be lowered.

While the invention has been described in detail and with reference to specific embodiments thereof, it will be apparent to one skilled in the art that various changes and modifications can be made therein without departing from the spirit and scope thereof.

What is claimed is:

1. A process for continuously producing a light-sensitive silver halide emulsion comprising the following steps:

(a) carrying out nucleation by batchwise reacting in at least one first medium-sized reaction vessel an aqueous solution of a silver salt and an aqueous solution of a halide salt to form a silver halide emulsion comprising stable silver halide nuclei;

(b) transferring said silver halide emulsion to at least one second medium-sized reaction vessel;

(c) adding an agent selected from the group consisting of (1) an aqueous silver salt solution and an aqueous halide salt solution; and (2) silver halide fine grains having an average diameter of at most 0.1 μm; to said silver halide emulsion in said second medium-sized reaction vessel and batchwise reacting said mixture to grow silver halide on said silver halide grains;

(d) subsequently transferring the silver halide emulsion from said at least one second medium-sized reaction vessel to at least one third medium-sized reaction vessel; and (e) batchwise subjecting said silver halide emulsion in said at least one third medium-sized reaction vessel to at least one of desalting or chemical sensitization, wherein the at least one first medium-sized reaction vessel has a volume of at least 10 liters and each of the second and third medium-sized reaction vessels has a volume of at least 20 liters; and said batchwise reactions in each of said steps (a) and (c) are performed in as equal a time period as possible.

2. The process as claimed in claim 1, wherein after transferring said silver halide emulsion to said at least one second medium-sized vessel in step (b), step (a) is repeated with subsequent new reactants as said batchwise reaction in step (c) proceeds and wherein after transferring said silver halide emulsion from said at least one second medium sized vessel to said at least one third medium-sized reaction vessel in step (d), step (c) is repeated with subsequent new reactants as said batchwise reaction (e) proceeds.

3. The process as claimed in claim 2, wherein after transferring said silver halide emulsion to said at least one second medium sized reaction vessel in step (b) and prior to repeating step (a) with subsequent new reactants, said at least one first medium-sized reaction vessel is washed.

4. The process as claimed in claim 1, wherein in step (a) said batchwise reaction is conducted in a plurality of said first medium-sized reaction vessels, and said silver halide emulsion is transferred in step (b) to a single second medium-sized reaction vessel.

5. The process as claimed in claim 4, wherein from 2 to 5 of said first medium-sized reaction vessels are used in step (a).

6. The process as claimed in claim 5, wherein each of said first medium-sized reaction vessels has a capacity of smaller than 300 l.

7. The process as claimed in claim 1, wherein in step (e) said silver halide emulsion is desalted and dehydrated using a medium-sized centrifugal dehydration vessel.

8. The process as claimed in claim 7, wherein said desalted and dehydrated silver halide emulsion from step (e) is subsequently transferred to at least one fourth medium-sized reaction vessel and subjected to batchwise chemical sensitization in said fourth medium-sized reaction vessel.

9. The process as claimed in claim 1, wherein the size and number of said first medium-sized reaction vessels in step (a), the size and the number of said medium-sized reaction vessels in step (c), and the size and number of said medium-sized reaction vessels in step (e) are each selected such that said batchwise reaction in step (a), said batchwise reaction in step (c), and said batchwise reaction in step (e) are each performed in as equal a time period as possible.

10. The process as claimed in claim 9, wherein the difference between the time required for said batchwise reaction in step (a), said batchwise reaction in step (c), and said batchwise reaction in step (e) is at most about 30%.

11. The process as claimed in claim 1, wherein after each of steps (b) and (d), the amount of solution remaining in each respective reaction vessel after transferring the emulsion is not more than 10% based on the amount of the solution transferred.

12. The process as claimed in claim 1, wherein said transferring time in each of steps (b) and (d) is conducted within 2 minutes.

13. The process as claimed in claim 1, wherein the difference between the time required for said batchwise reaction in step (a) and said batchwise reaction in step (c) is at most 30%.

14. The process as claimed in claim 1, wherein the volume of said at least one firs medium-sized reaction vessel is from 10 to 700 liters and the volume of each of the second and third medium-sized reaction vessels are 20 to 1000 liters.

* * * * *